US005896759A

United States Patent [19]

Barrena et al.

[11] Patent Number: 5,896,759

[45] Date of Patent: Apr. 27, 1999

[54] INTERLOCK WITH SAFETY

[76] Inventors: Juan J. Barrena, 107 Merino St., Providence, R.I. 02909; James M. Carroll, Jr., 6 Hunting St., Wellesley, Mass. 02181

[21] Appl. No.: 08/915,309

[22] Filed: Aug. 19, 1997

[51] Int. Cl.[6] ..... D06F 37/28

[52] U.S. Cl. ..... 68/12.26; 200/61.62; 134/56 DL; 134/57 DL; 134/58 DL

[58] Field of Search ..... 68/12.02, 12.26; 200/61.62; 134/57 DL, 58 DL, 56 DL

[56] References Cited

U.S. PATENT DOCUMENTS

| | | | |
|---|---|---|---|
| 3,111,830 | 11/1963 | Low | 68/12.26 |
| 3,285,036 | 11/1966 | Erickson | 68/12.26 |
| 3,451,233 | 6/1969 | Shopsky | 68/12.26 |
| 3,673,824 | 7/1972 | Ripsco et al. | 68/12.26 |
| 3,735,610 | 5/1973 | Haller | 68/12.26 |
| 3,763,670 | 10/1973 | Harrold | 68/12.26 |
| 5,038,587 | 8/1991 | Harmelink | 68/12.26 |
| 5,520,026 | 5/1996 | Ackland | 68/12.26 |
| 5,600,976 | 2/1997 | Hapke et al. | 68/12.26 |

FOREIGN PATENT DOCUMENTS

| | | | |
|---|---|---|---|
| 2318363 | 10/1974 | Germany | 68/12.26 |
| 2262209 | 6/1975 | Germany | 68/12.26 |
| 2-102697 | 4/1990 | Japan | 68/12.26 |

*Primary Examiner*—Frankie L. Stinson

[57] ABSTRACT

A mechanical coupling mechanism links an access door, a push-to-start button, and a switch controlling power to machinery behind the access door. The coupling mechanism permits the door to be open and the switch to be open, the door to be closed and the switch to be open, and the door to be closed and the switch to be closed, while forbidding the door to be open and the switch to be closed. The coupling precludes an operator shifting from a condition with the door open and the switch open to that in which the door is closed and the switch is closed with a single action.

2 Claims, 4 Drawing Sheets

INTERLOCK WITH SAFETY

BRIEF SUMMARY OF THE INVENTION

The invention relates to interlock mechanisms for clothes washing machines and the like where moving machinery is behind an access door or lid and the machinery must be turned off whenever the access door is opened.

The invention features a mechanical coupling mechanism linking an access door, a push-to-start button, and a switch controlling power to machinery behind the access door. Many interlock devices permit start of machinery by simply closing the access door. The coupling mechanism according to this invention applies power to the machinery only if the push-to-start button is pressed after the access door is closed and ensures against accidents such as an infant tumbling into the machinery enclosure while pulling the access door down after him.

DETAILED DESCRIPTION

Figure 1:
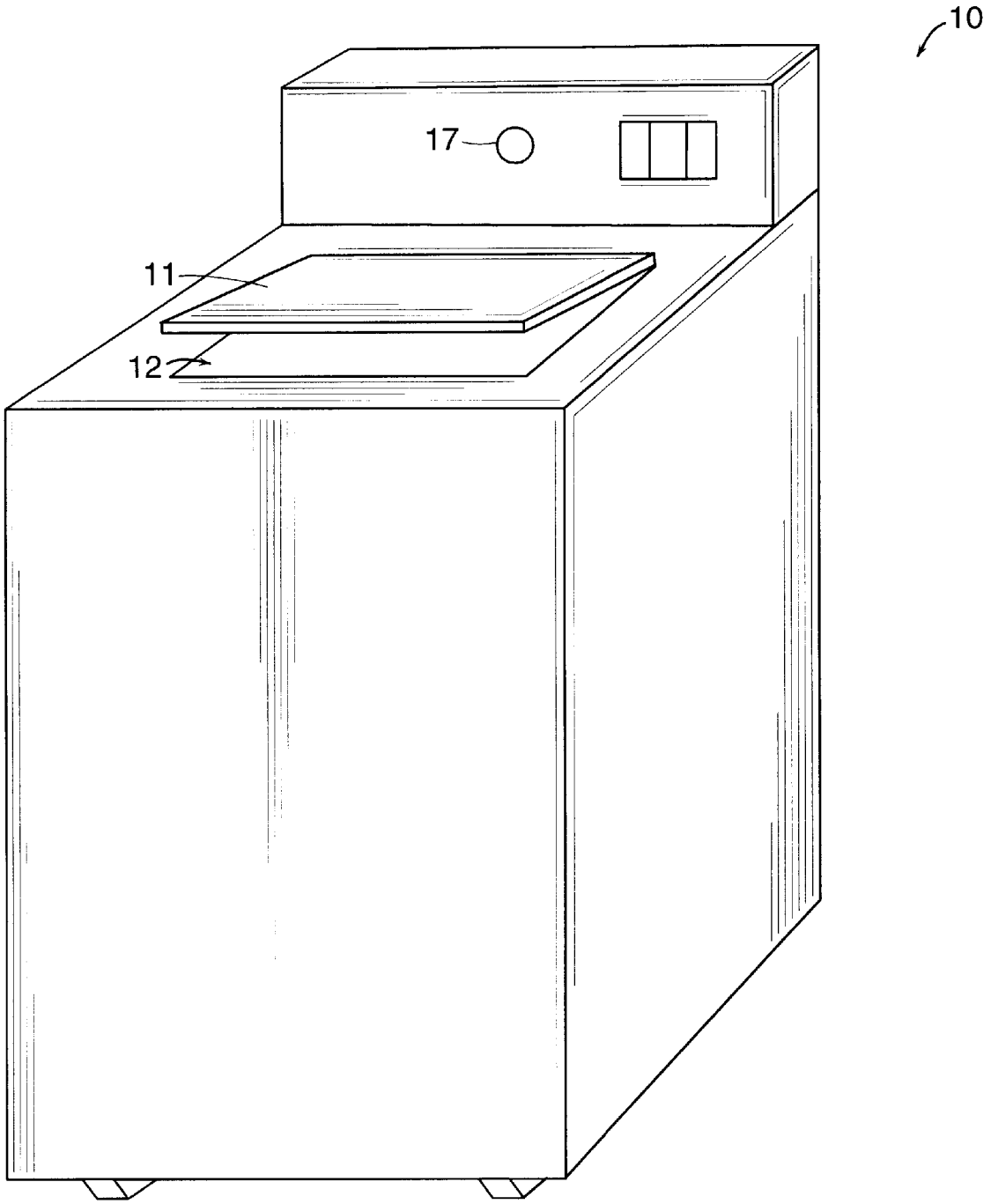
FIG. 1 shows a clothes washing machine with a coupling according to the invention.
Figure 2:
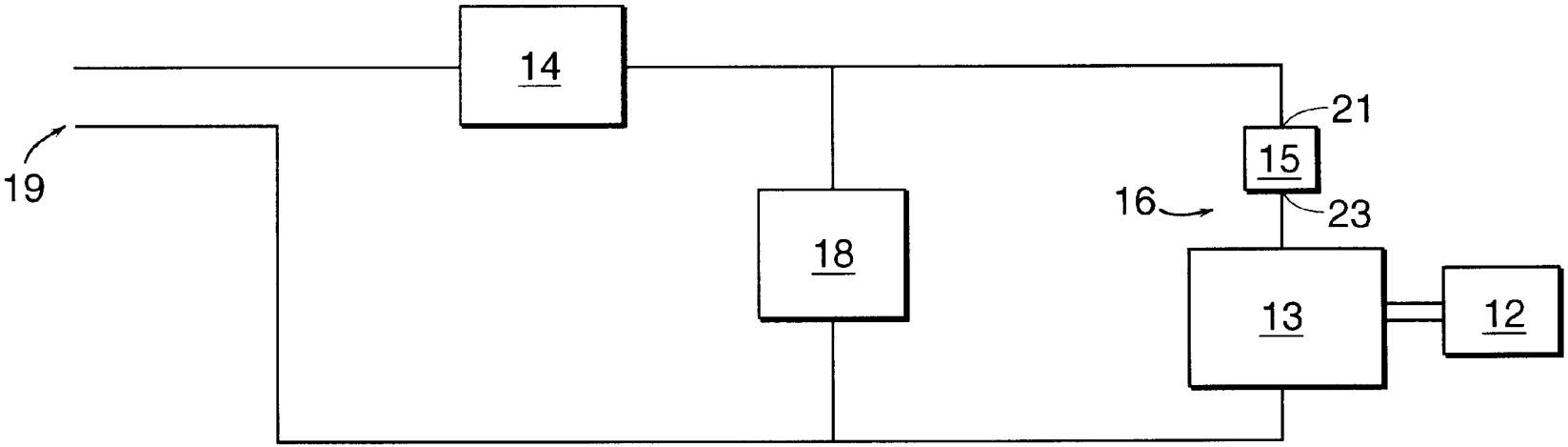
FIG. 2 shows schematically electrical circuitry of the clothes washing machine of FIG. 1.

An appliance such as the fabric washing machine 10 shown in FIG. 1 has access door 11 giving access to rotating machinery such as spin chamber 12 driven by motor 13. Controls 14 generally control application of power from mains 19 to washing machine components 18, and switch 15 particularly controls application of power to motor 13 through circuit 16. Push-to-start button 17 receives a mechanical input from an operator to start operation of spin chamber 12.

Figure 3:
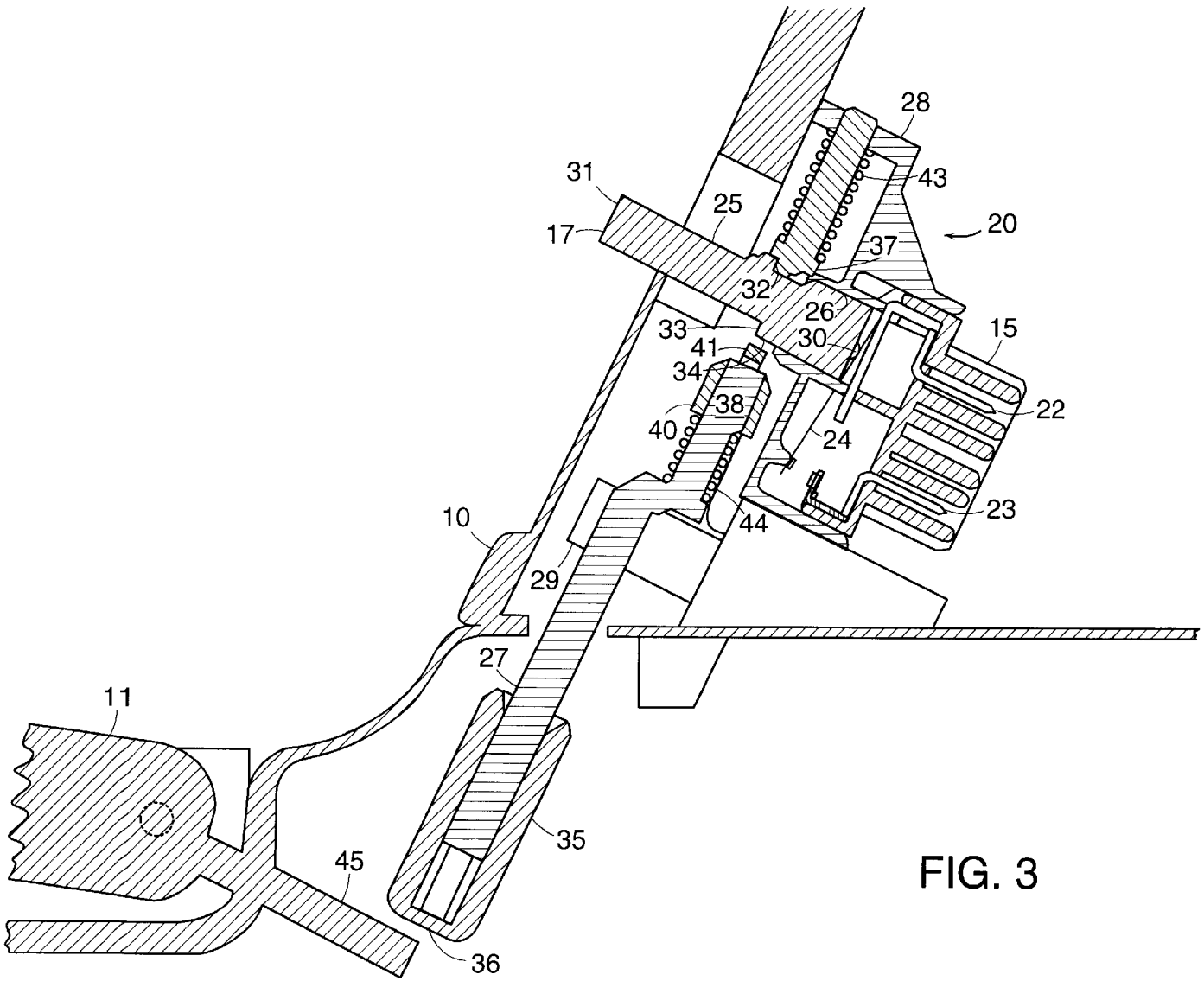
FIG. 3 shows in cross section part of the frame and the coupling of the washing machine of FIG. 1, the view being from the side of the washing machine.
Figure 4:
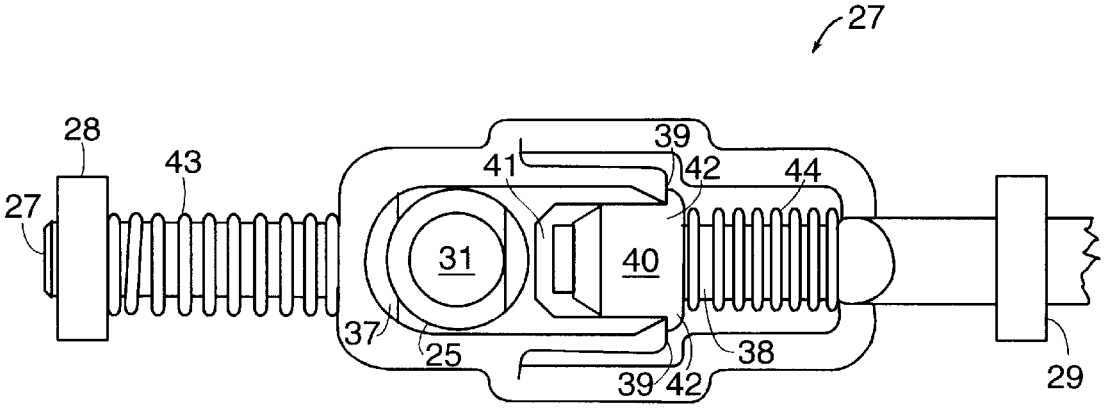
FIG. 4 shows the coupling of FIG. 3 as seen from the front of the clothes washing machine, the parts being in the position which they occupy when the access door of the washing machine is open.

As shown more particularly in FIGS. 3 and 4, a mechanical coupling such as linkage 20 links access door 11 to switch 15 in circuit 16. Housing 21 supports electrical terminals 22 and 23. Movable contactor 24 is connected to terminal 22 and is biased to move to a position in which it does not connect terminals 22 and 23 and can be moved to a position in which it connects the terminals.

Actuator shaft 25 is supported on slide bearing 26 of housing 21 so that it can move toward and away from contactor 24 over a range; coupling rod 27 is supported on slide bearings 28 and 29 of housing 21 permitting linear motion of coupling rod over a range and in a direction at right angles to the motion of actuator shaft 25.

Actuator shaft 25 includes contactor bearing surface 30 facing toward and bearing on contactor 24, push-start surface 31 facing away from contactor 24, lock-out surface 32 on a first side of actuator shaft and facing toward contactor 24, and, on a second side of actuator shaft opposite the first side, lock-in surface 33 facing away from contactor 24, and pawl-hold-out surface 34 facing at right angles to lock-in surface 33.

Coupling rod 27 includes length adjustment sleeve 35 terminating in access door engagement surface 36, lockout key 37 positioned to face the first side of actuator shaft 25, pawl support 38, and pawl stop 39.

Pawl 40 is supported on pawl support 38 and includes pawl key 41 and pawl catches 42. Spring 43 biases lockout key 37 toward actuator shaft 25, and spring 44 biases pawl key toward actuator shaft 25.

Figure 5:
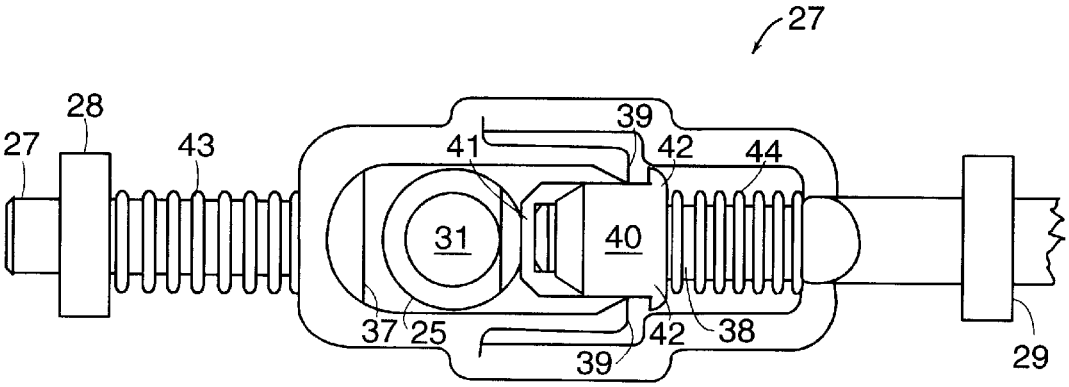
FIG. 5 shows the coupling of FIG. 3 as seen from the front of the clothes washing machine, the parts being in the position which they occupy when the access door of the washing machine has been closed.
Figure 6:
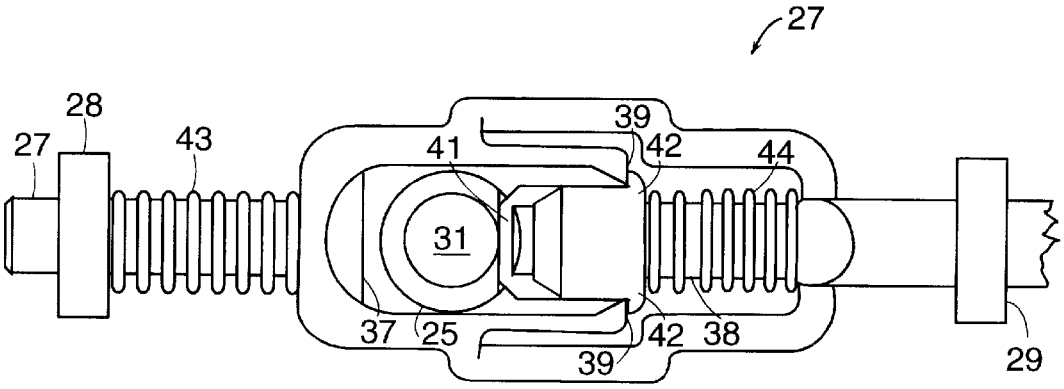
FIG. 6 shows the coupling of FIG. 3 as seen front the front of the clothes washing machine, the parts being in the position which they occupy when the access door of the washing machine is closed and the machinery is running.

The operation of the invention may be explained with reference to three states or configurations of the coupling designated as 0-0, 1-0, and 1-1, shown respectively in FIGS. 4, 5, and 6. With the access door open and switch 15 open (state 0-0), access door extension 45 does not engage the coupling rod; the actuator shaft is pushed by contactor 24 to the left (as shown in FIG. 3) and the coupling rod with its attached lockout key 37 and pawl stop 39 is biased by spring 43 downward (as shown in FIG. 3) so that pawl key 41 is pulled back from the actuator shaft, and lockout key 37 is advanced behind lock-out surface 32. This state is shown in FIGS. 3 and 4 show the various parts in the position of state 0-0. From this state the switch cannot be closed because the lockout key is in position to prevent motion of the actuator shaft to push the contactor to the closed position. The access door can, however, be closed to transfer to state 1-0.

With the access door closed and the switch open (state 1-0), access door extension 45 engages the coupling rod, pushing it upwards against the bias of spring 43 so that lockout key is withdrawn from behind lock-out surface 32 and the pawl, now free from the pawl stop, is pushed by spring 44 so that pawl key 41 is pressing against pawl-hold-out surface 34. The actuator shaft is pushed by contactor 24 away from the switch. The position of the parts in the 1-0 state is shown in FIG. 5. From the 1-0 state the access door can be opened to put the coupling back into the 0-0 state, or in the more usual sequence the push-to-start surface is pushed by an operator to close the switch and shift the coupling to state 1-1.

When in state 1-0 the push-to-start button is pushed, the actuator shaft is moved to close the switch and permit the pawl key to snap behind lock-in surface 33. This configuration, state 1-1, is shown in FIG. 6. From state 1-1 the coupling can be shifted to state 0-0 by opening the access door , but other changes of state are precluded.

The coupling of the invention thus permits an operator to control access to and application of power to machinery in a useful way while giving an operator no way to put the equipment in the dangerous state in which there is access to moving machinery, and further precluding transfer of the equipment from an initial state (0-0) to the operating state (1-1) with a single action.

We claim:

1. A washing machine with a chamber for holding fabric material, an access door which in a closed position covers said chamber and in an open position gives access to said chamber, a motor connected to spin said chamber, a switch controlling power to said motor, and a start button for receiving a mechanical input from an operator to initiate spinning of said chamber, said washing machine including a mechanical coupling linking said start button, said access door, and said switch, said mechanical coupling permitting said washing machine to be in one of three permitted states, the first of said permitted states being said access door open and said switch open, the second of said permitted states being said access door closed and said switch open, and the third of said permitted states being said access door closed and said switch closed, while forbidding said washing machine from being in a state with said access door open and said switch closed, said mechanical coupling permitting change of said washing machine's state from said first permitted state to said second permitted state, from said second permitted state to said first permitted state, from said second permitted state to said third permitted state, and from said third permitted state to said first permitted state, while forbidding change of said washing machine from said third permitted state to said second permitted state or from said first permitted state to said third permitted state.

2. A linkage for linking an access door and a circuit applying poser to machinery comprising a housing, an actuator shaft, and a coupling bar, said housing supporting two electrical terminals, a movable contactor being connected to one of said terminals and being movable to a closed position in which it connects said terminals and to an open position in which it does not connect said terminals, said movable contactor being biased toward said open position, said housing supporting said actuator shaft and permitting linear motion thereof over a range, said housing supporting said coupling rod and permitting linear motion thereof over a range, the permitted motion of said actuator being towards and away from said contactor and the permitted motion of said coupling rod being at right angles to the motion of said actuator shaft, said actuator shaft having a contactor bearing surface facing toward and bearing on said contactor, a push-start surface facing away from said contactor for receiving a force from an operator to start machinery, a lock-out surface on a first side of the actuator shaft and facing toward said contactor, a lock-in surface on a second side of the actuator shaft opposite said first side and facing away from said contactor, and a pawl-hold-out surface on said second side of the actuator facing at right angles to said lock-in surface, said coupling rod having a access door engagement surface for engaging an access door, a lockout key extending toward said first side of said actuator shaft, said lockout key being biased toward said actuator shaft, a pawl support and a pawl stop, a pawl with a pawl key being supported on said pawl support in a position with said pawl key facing said second side of said actuator shaft, and being biased to move toward said actuator shaft, said pawl including a pawl catch which engages said pawl stop to limit motion of the pawl toward the actuator shaft, said linkage being constructed and arranged so that when said access door engagement surface is not engaged with an access door said lookout key is biased to a position where it interferes with said lock-out surface and prevents movement of said actuator toward said contactor, and said pawl key is moved by said pawl stop to a position where it does not interfere with said look-in surface, and when said access door engagement surface is engaged with an access door said lockout key is moved to a position where it does not interfere with said lock-out surface, and said pawl key is, when said contactor is in its open position, biased against said pawl-hold-out surface, and is, when said contactor is in its closed position biased to a position where it interferes with said lock-in surface.

* * * * *

UNITED STATES PATENT AND TRADEMARK OFFICE

CERTIFICATE OF CORRECTION

PATENT NO. : 5896759

DATED : Apr 27, 1999

INVENTOR(S) : Barrena et al

It is certified that error appears in the above-identified patent and that said Letters Patent is hereby corrected as shown below:

In col 3, line 22: "poser" should be --power--.

Signed and Sealed this

Twenty-seventh Day of July, 1999

*Attest:*

Q. TODD DICKINSON

*Attesting Officer*

*Acting Commissioner of Patents and Trademarks*